US008434215B2

(12) United States Patent
Naito et al.

(10) Patent No.: US 8,434,215 B2
(45) Date of Patent: May 7, 2013

(54) SELF-PIERCING RIVET SETTING MACHINE

(75) Inventors: Nobuharu Naito, Toyohashi (JP); Masahiro Hasegawa, Toyohashi (JP); Itsuo Endo, Shizuoka-ken (JP); Misao Tsutsumi, Shizuoka-ken (JP); Takashige Sekimoto, Shizuoka-ken (JP)

(73) Assignee: Newfrey LLC, Newark, DE (US)

( * ) Notice: Subject to any disclaimer, the term of this patent is extended or adjusted under 35 U.S.C. 154(b) by 257 days.

(21) Appl. No.: 13/021,045

(22) Filed: Feb. 4, 2011

(65) Prior Publication Data

US 2011/0173803 A1 Jul. 21, 2011

Related U.S. Application Data

(63) Continuation of application No. PCT/US2009/052799, filed on Aug. 5, 2009.

(30) Foreign Application Priority Data

Aug. 5, 2008 (JP) ..... 2008-201834

(51) Int. Cl.
*B21J 15/10* (2006.01)
*B23P 21/00* (2006.01)

(52) U.S. Cl.
USPC ..... 29/712; 29/716; 29/798; 29/432.1; 29/524.1

(58) Field of Classification Search ..... 29/709, 29/712, 716, 798, 432.1, 432.2, 524.1, 525.06
See application file for complete search history.

(56) References Cited

U.S. PATENT DOCUMENTS

| | | | | |
|---|---|---|---|---|
| 6,067,696 | A * | 5/2000 | Cecil et al. | 29/407.01 |
| 6,276,050 | B1 * | 8/2001 | Mauer et al. | 29/716 |
| 6,502,008 | B2 * | 12/2002 | Maurer et al. | 700/175 |
| 6,862,793 | B2 * | 3/2005 | Frenken | 29/525.06 |
| 7,032,296 | B2 * | 4/2006 | Zdravkovic et al. | 29/709 |
| 7,123,982 | B2 * | 10/2006 | Mauer et al. | 700/175 |
| 7,331,098 | B2 * | 2/2008 | Matthews et al. | 29/524.1 |
| 7,673,377 | B2 * | 3/2010 | Clew | 29/407.1 |
| 2001/0027597 | A1 * | 10/2001 | Mauer et al. | 29/407.04 |
| 2004/0167660 | A1 * | 8/2004 | Mauer et al. | 700/175 |
| 2005/0132563 | A1 * | 6/2005 | Schmidt | 29/715 |
| 2005/0204549 | A1 * | 9/2005 | Vrana | 29/715 |
| 2006/0090320 | A1 * | 5/2006 | Matthews et al. | 29/407.09 |
| 2007/0056153 | A1 * | 3/2007 | Opper et al. | 29/432 |
| 2008/0066286 | A1 * | 3/2008 | Saathoff | 29/432.1 |

FOREIGN PATENT DOCUMENTS

| | | | |
|---|---|---|---|
| JP | 06-039650 | A | 2/1994 |
| WO | 2005095019 | A | 10/2005 |

* cited by examiner

*Primary Examiner* — Jermie Cozart
(74) *Attorney, Agent, or Firm* — Michael P. Leary

(57) ABSTRACT

A self-piercing rivet setting machine comprises a C-shaped arm and a receiver section disposed at one end of the C-shaped arm to receive a self-piercing rivet fed from a feeder. The receiver section has a rivet-reach detection sensor to detect the presence or absence of a self-piercing rivet in a driving chamber therein. If the rivet-reach detection sensor detects the absence of any self-piercing rivet in the driving chamber, the sensor outputs a signal to prevent a punch from being driven.

6 Claims, 3 Drawing Sheets

SELF-PIERCING RIVET SETTING MACHINE

CROSS-REFERENCE TO RELATED APPLICATIONS

This application is a continuation of PCT Application No. PCT/US2009/052799, filed Aug. 5, 2009 which claims the benefit of Japanese Application No. 2008-201834 filed Aug. 5, 2008, the disclosure of which is incorporated herein by reference.

BACKGROUND OF THE INVENTION

The present invention relates to a self-piercing rivet fastening device, and more particularly to a self-piercing rivet fastening device that can prevent self-piercing rivet dry-firing.

One example of a self-piercing rivet fastening device is described in JP 2007-530287, Gazette (Patent Literature 1). A self-piercing rivet comprises a flange-shaped head and a hollow tubular leg that extends downward from the head. When this rivet is driven into a plurality of members being fastened, such as two panels or the like, for example, the leg perforates the panels, and, while that is occurring, the leg deforms so that the tip thereof expands, whereupon the plurality of members being fastened is joined together by the deformed and expanded leg and the head. Self-piercing rivets are suitable for joining aluminum bodies which are not amenable to welding, and, in view of the fact that aluminum bodies are being adopted for automobile bodies as lighter weights are now being sought, the demand therefor is expected to grow.

The self-piercing rivet fastening device cited in Patent Literature 1 has a C-shaped frame, a punch disposed at one end of the C-shaped frame, and a die disposed at the other end so as to be opposed to the punch. At the one end of the C-shaped frame, a receiver is disposed for accepting self-piercing rivets fed from the self-piercing rivet feeder, and a feeder tube extending from the feeder is connected to the receiver. The punch is attached so as to drive in, toward the die, a self-piercing rivet sent to a driving chamber in the receiver. A self-piercing rivet driven in by the punch is driven into a plurality of members being fastened, those being disposed between the punch and the die, while perforating those members, whereupon the plurality of members being fastened is fastened together.

Patent Literature 1: PCT (WO) 2007-530287, Gazette

Patent Literature 2: TOKKAI [Unexamined Patent Application] No. H6-039650

In the self-piercing rivet fastening device of Patent Literature 1, sensors (281, 283) for detecting the presence of a self-piercing rivet are provided in the feeder tube between the feeder and the receiver. These sensors are supposed to prevent dry-firing by the punch when there is no self-piercing rivet in the receiver. This detection of the presence of a self-piercing rivet is desirable because it prevents punch dry-firing, but is to detect the presence of a self-piercing rivet inside the feeder tube, and is not to detect the presence of a self-piercing rivet that has arrived in the driving chamber of the receiver. Wherefore, there is room for improvement in the self-piercing rivet fastening device of Patent Literature 1 from the perspective of preventing punch dry-firing.

Patent Literature 2 describes a self-piercing rivet fastening device wherein the presence of members being fastened is detected and whereby, when there is no member being fastened between the punch and the die, self-piercing rivet driving is prevented. In Patent Literature 2, there is no description of any detection of the presence of a self-piercing rivet in the receiver.

BRIEF SUMMARY OF THE INVENTION

Accordingly, an object of the present invention is to detect whether or not a self-piercing rivet is in the driving chamber of the receiver and definitely prevent punch dry-firing.

In order to attain said object, the self-piercing rivet fastening device pertaining to the present invention is a self-piercing rivet fastening device with a C-shaped frame, wherein a punch is disposed on one end of that C-shaped frame, a die is disposed on the other end thereof so as to oppose the punch, a receiver for accepting a self-piercing rivet fed from a self-piercing rivet feeder is deployed on the first-mentioned end of the C-shaped frame, a feeder tube extending from the feeder is connected to that receiver, the punch is attached so as to drive in, toward the die, a self-piercing rivet sent to a driving chamber of the receiver, a self-piercing rivet driven in by the punch opens holes in and is driven into a plurality of members being fastened that are deployed between the punch and the die, so that the plurality of members being fastened is fastened together, being configured such that a rivet arrival detection sensor is provided in the receiver for detecting whether or not a self-piercing rivet is present in the driving chamber, and, when the rivet arrival detection sensor has detected that no self-piercing rivet is present in the driving chamber, the drive for the punch is prevented in response to a signal from that sensor.

As noted above, in the receiver, a rivet arrival detection sensor is provided for detecting whether or not a self-piercing rivet is present in the driving chamber, and, when the punch is [to be] driven, if the rivet arrival detection sensor detects that no self-piercing rivet is present in the driving chamber, the punch is prevented, in response to a signal from the sensor, from being driven. Because the device is so configured, punch dry-firing is definitely prevented.

In the self-piercing rivet fastening device described above, the receiver has an intake passageway for receiving a self-piercing rivet sent from the feeder tube, and a driving chamber, the latter being formed at a position at which self-piercing rivets are received from the intake passageway and at which a drive passageway of the punch is crossed and the self-piercing rivets are impacted by the punch and the rivet arrival detection sensor is disposed adjacent to the driving chamber at a position where the intake passageway will not be obstructed. In this fastening device, a turnable gate is provided in the receiver whereby the intake passageway and the driving chamber can be partially opened; said gate is configured so that the intake passageway and the driving chamber are normally closed but can be turned so as to partially open the intake passageway and the driving chamber for the removal of a jammed self-piercing rivet. In that fastening device, the rivet arrival detection sensor is disposed in a position where the opening and closing of the gate will not be obstructed, that being a position also where the intake passageway is opposed. In order to detect a self-piercing rivet that is sent from the self-piercing rivet feeder, a rivet arrival detection sensor is provided either at the discharge port of the feeder or at the intake of the feeder tube. Whether the feeding of a self-piercing rivet from the feeder tube to a point just short of the driving chamber is proper or improper can be detected.

DETAILED DESCRIPTION OF THE PREFERRED EMBODIMENT

Figure 1:
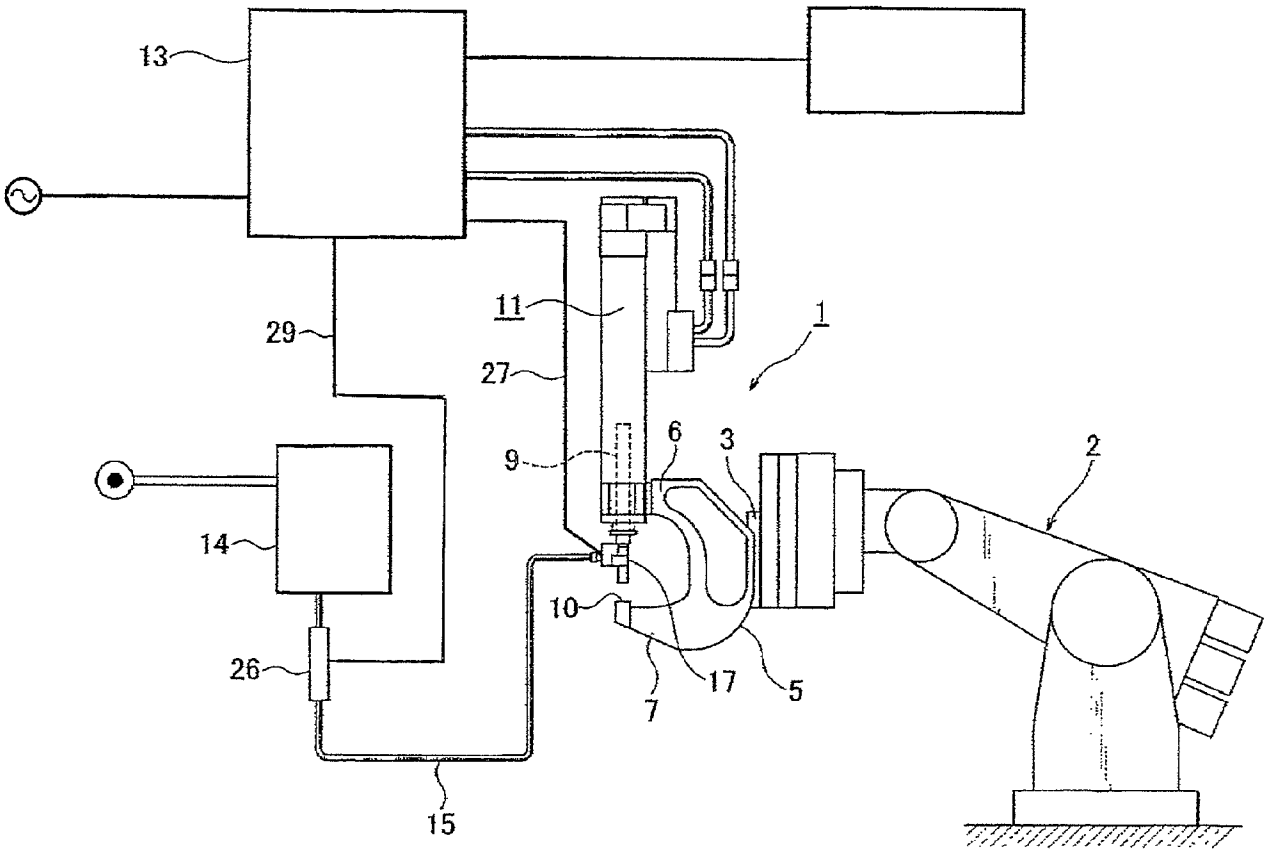
FIG. 1 is a configuration diagram of a self-piercing rivet fastening device relating to one embodiment of the present invention.

An embodiment of the present invention is now described. FIG. 1 is an overall diagram of a self-piercing rivet fastening device 1 relating to the embodiment of the present invention. In FIG. 1, the self-piercing rivet fastening device 1 has a C-shaped frame 5 which has a connecting part 3 for connecting to an articulated robot arm 2. The C-shaped frame 5 is a rigid member wherein an upper horizontal arm 6, a vertical arm wherein the connecting part 3 is disposed, and a lower horizontal arm 7 are integrally formed. One end of the C-shaped frame 5, that is, the upper horizontal arm 6 end, is secured to a tubular shaped punch drive 11, constituting punch drive means, for driving a punch 9 formed so as to hold a self-piercing rivet 8 (FIG. 2), and so as to press the rivet toward a die 10 therebelow, at the time of a fastening action. In this embodiment, the punch drive 11 comprises an electric motor, a spindle that is turned by that electric motor and which moves up and down, and a rod or the like extending from the spindle to the punch 9. By the turning of the electric motor, the spindle moves downward and powerfully pushes the self-piercing rivet 8 held by the punch 9 to the die 10 side. The punch 9 can be retracted by the reverse turning of the electric motor. The punch drive 11 may be hydraulic, air-pressure or other drive means. The die 10 is disposed at the other end of the C-shaped frame 5, that is, at the lower horizontal arm 7 end so as to oppose the punch 9, being disposed so as to receive the leg of a self-piercing rivet driven in by the punch 9.

To the self-piercing rivet fastening device 1 is connected a controller 13, which controller 13 controls the action of the punch drive 11. To the self-piercing rivet fastening device 1 is also connected a feeder tube 15 that extends from the self-piercing rivet feeder 14 and feeds self-piercing rivets one at a time to a point below the punch 9. In the portion of the upper horizontal arm 6 of the C-shaped frame 5 where the punch 9 is disposed, a receiver 17 is disposed for receiving self-piercing rivets and holding the self-piercing rivets at the position where they are driven in. The feeder tube 15 is connected to the receiver 17. The self-piercing rivet feeder 14 is controlled by the controller 13, which controls the drive of the punch 9 and the feeding of the self-piercing rivets so that such drive and feeding are proper.

Figure 2:
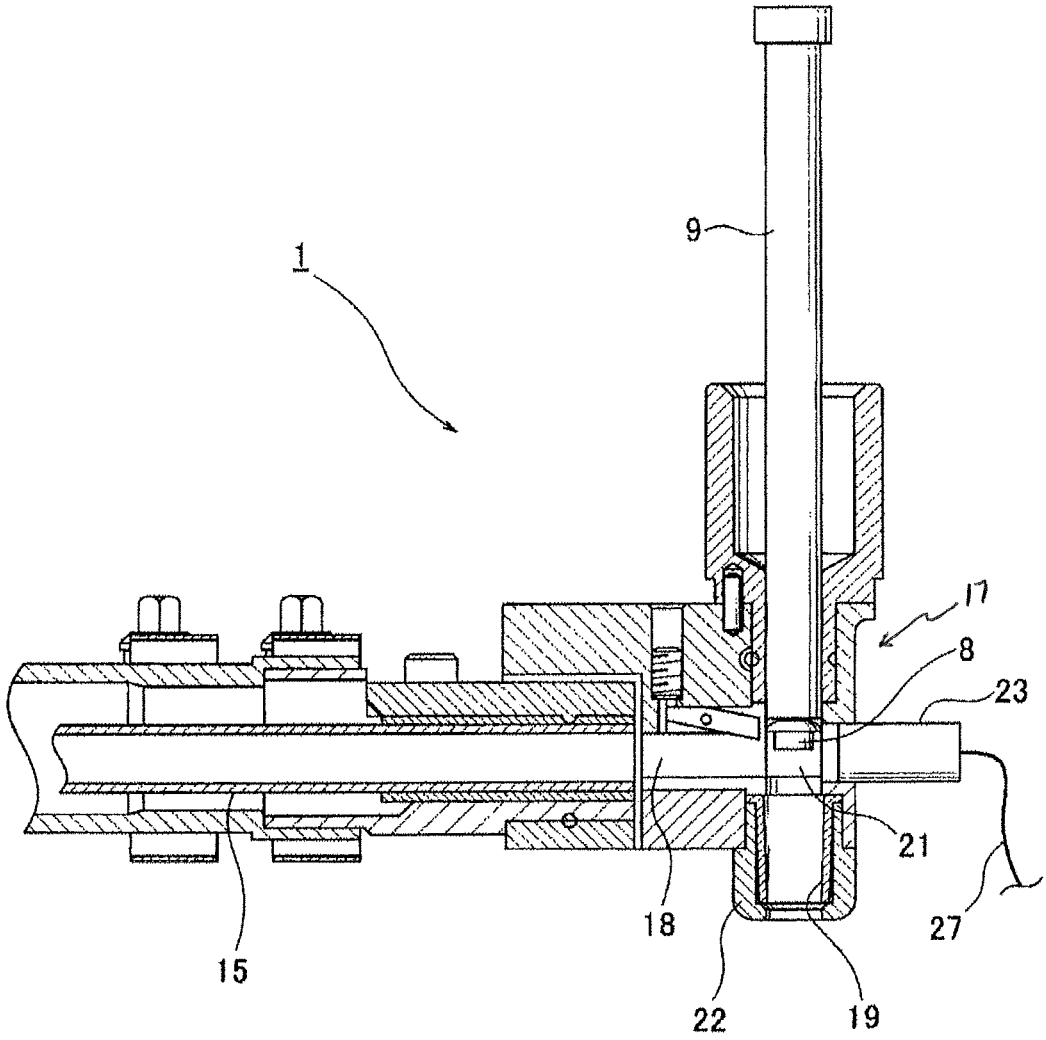
FIG. 2 is a section of the receiver and the punch portions of the self-piercing rivet fastening device diagrammed in FIG. 1.
Figure 3:
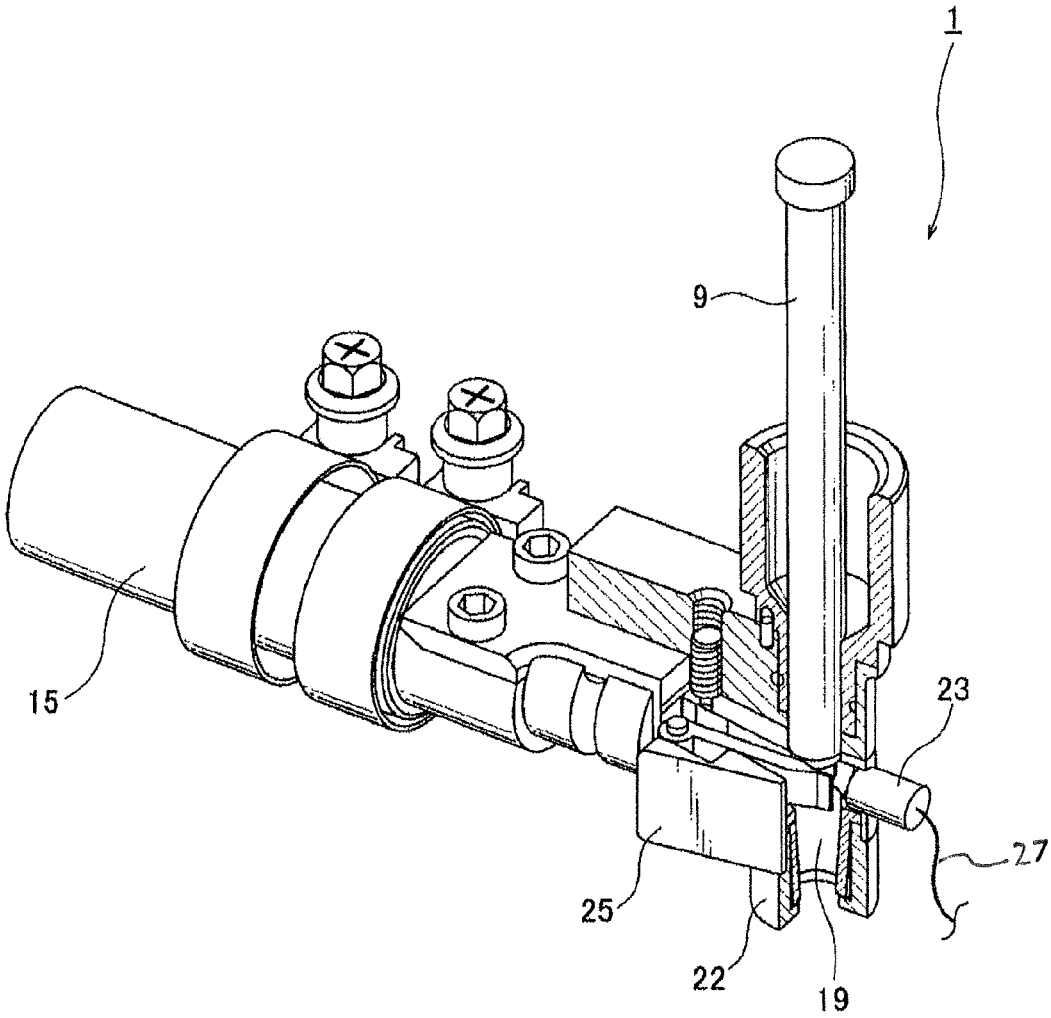
FIG. 3 is a partially cutaway diagonal view of the receiver and punch portions of the self-piercing rivet fastening device diagrammed in FIG. 1.

FIGS. 2 and 3 are a vertical section and partially cutaway diagonal view of the portions of the self-piercing rivet fastening device 1 where the receiver 17 and punch 9 are located. The receiver 17 has an intake passageway 18 for receiving self-piercing rivets sent from the feeder tube 15 and a driving chamber 21 for receiving self-piercing rivets from the intake passageway 18, formed at a position which crosses a drive passageway 19 of the punch 9 and at which the self-piercing rivets 8 are impacted by the punch 9. Downward from the driving chamber 21, a nose 22 that forms the drive passageway 19 is disposed. The self-piercing rivets 8 that are sent through the feeder tube 15 are automatically fed, by compressed air or the like, for example, in a proper attitude in the intake passageway 18 and driving chamber 21 of the receiver 17. The self-piercing rivets 8 that are held in a proper attitude in the driving chamber 21 are driven in toward the die 10 (FIG. 1) by the descending of the punch 9, and self-piercing rivets 8 driven by the punch 9 are driven into the plurality of members being fastened (not shown in the drawings) while perforating them, whereupon the plurality of members being fastened is fastened together. The legs of the self-piercing rivets 8, in the lowermost member being fastened, do not punch through that member being fastened but expand outwardly in the radial direction just short of the lower surface thereof, and the driving-in terminates just short of the lower surface without penetrating through the lower surface.

In the receiver 17, a rivet arrival detection sensor 23 is provided for detecting whether or not a self-piercing rivet 8 is present in the driving chamber 21. The sensor 23 is disposed at a position that is adjacent to the driving chamber 21 and at which the intake passageway 18 will not be obstructed. In the embodiment diagrammed, as indicated in FIG. 3, in the receiver 17 is provided a turnable gate 25 capable of partially opening the intake passageway 18 and partially opening the driving chamber 21. The gate 25 is configured so as normally to close the intake passageway 18 and driving chamber 21, but can be turned so as to partially open the intake passageway 18 and partially open the driving chamber 21. When such a gate 25 is present, the rivet arrival detection sensor 23 is disposed at a position where the opening and closing of the gate 25 will not be obstructed. In order to satisfy these conditions, in the embodiment diagrammed, the rivet arrival detection sensor 23, as indicated in FIGS. 2 and 3, is deployed at a position that is adjacent to the driving chamber 21 and also opposes the driving chamber 21. The rivet arrival detection sensor 23 will typically be an optical sensor, but it may be some other sensor, such as one that employs a proximity switch, for example. Output signals from the rivet arrival detection sensor 23 are input via a signal line 27 to the controller 13.

Furthermore, as diagrammed in FIG. 1, a rivet feed detection sensor 26 is provided either in the vicinity of the discharge port of the self-piercing rivet feeder 14 or in the vicinity of the intake of the feeder tube 15. This rivet feed detection sensor 26 detects that a self-piercing rivet has been sent from the feeder 14 to the receiver 17. The rivet feed detection sensor 26 will typically be a sensor that uses the impedance of an electromagnetic coil, but a sensor that employs a proximity switch may also be used. The output signals from the rivet feed detection sensor 26 are input, via another signal line 29, together with other signals, to the controller 13.

The controller 13 is configured so that, when the rivet arrival sensor 23 has detected that no self-piercing rivet 8 is present in the driving chamber 21 of the receiver 17, the drive (driving-in) of the punch 9 is prevented in response to a signal from the rivet arrival sensor 23. Thus, if the rivet arrival sensor 23 detects that no self-piercing rivet 8 is present in the driving chamber 21, then the drive of the punch 9 will be prevented so that dry firing of the punch 9 is definitely prevented. Moreover, when the controller 13, after first receiving a self-piercing rivet feed signal from the rivet feed detection sensor 26, then detects a self-piercing rivet arrival signal from the rivet arrival detection sensor 23, the controller 13 recognizes a proper feed of a self-piercing rivet 8. But, when that feed time exceeds a certain time period, then the controller 13 can detect that the feed was improper. That is, by using the rivet arrival detection sensor 23 and the rivet feed detection sensor 26, the controller 13 can determine whether the feed of a self-piercing rivet 8 from the feeder tube 15 to the driving chamber 21 is proper or improper.

It will be appreciated by persons skilled in the art that the above embodiments have been described by way of example only, and not in any limiting sense, and that various alterations and modifications are possible without departure from the scope of the invention as defined by the appended claims.

The invention claimed is:

1. A self-piercing rivet fastening device operable to drive a self-piercing rivet into a plurality of work-piece members, so that the plurality of members are fastened together, the self piercing rivet fastening device comprising:

a C-shaped frame including a first end and a second end;

a rivet punch and a punch driver are located on the first end of the C-shaped frame, and a die is located on the second end of the C-shaped frame so as to oppose the punch, and the punch driver is selectively operable to drive the rivet punch toward the die;

a receiver including a rivet driving chamber, for accepting the rivet fed from a rivet feeder, is mounted on the first end of the C-shaped frame proximate to the punch; a rivet feeder tube extends from the rivet feeder and is connected to the receiver;

a moveable gate operatively associated with the rivet driving chamber and being provided in the receiver;

a rivet arrival detection sensor is provided proximate to the receiver for detecting whether the rivet is present in the rivet driving chamber;

the rivet arrival detection sensor being operative to directly sense the presence of the rivet in the rivet driving chamber independent of the position of the gate; and when the rivet arrival detection sensor has not detected that a rivet is present in the driving chamber, then the drive for the punch is prevented in response to a signal from that sensor.

2. The self-piercing rivet fastening device according to claim 1, wherein:

the receiver includes an intake passageway for receiving a rivet sent via the feeder tube;

the rivet driving chamber is formed at a position at which a drive passageway of the punch intersects the intake passageway, at the rivet driving chamber the rivet is received from the intake passageway and positioned for impact by the punch; and the rivet arrival detection sensor is disposed adjacent to the driving chamber at a position where the intake passageway will not be obstructed.

3. The self-piercing rivet fastening device according to claim 2, wherein, when the gate is in a first position, then the intake passageway and the driving chamber are closed, and when the gate is in a second position, then the intake passageway and the driving chamber are partially opened for the removal of a jammed rivet.

4. The self-piercing rivet fastening device according to claim 3, wherein the rivet arrival detection sensor is disposed in a position whereby the movement of the gate will not be obstructed.

5. The self-piercing rivet fastening device according to claim 1, wherein a rivet feed detection sensor is provided either at a discharge port of the feeder or at an intake of the feeder tube in order to detect a rivet that is sent from the rivet feeder toward the receiver.

6. The self-piercing rivet fastening device according to claim 5, further comprising a controller operatively associated with the rivet arrival detection sensor and the rivet feed detection sensor to determine whether the feed of a self-piercing rivet from the feeder tube to the driving chamber is proper or improper.

* * * * *